US005395684A

United States Patent [19]

Robinson et al.

[11] Patent Number: 5,395,684

[45] Date of Patent: Mar. 7, 1995

[54] THERMAL INSULATION MATERIALS

[75] Inventors: Frank Robinson, Derby; Patricia A. Solomon, Sowerby Bridge, both of England

[73] Assignee: Courtaulds Aerospace Limited, England

[21] Appl. No.: 90,151

[22] PCT Filed: Jan. 22, 1992

[86] PCT No.: PCT/GB92/00127

§ 371 Date: Aug. 6, 1993

§ 102(e) Date: Aug. 6, 1993

[87] PCT Pub. No.: WO92/13125

PCT Pub. Date: Aug. 6, 1992

[30] Foreign Application Priority Data

Jan. 23, 1991 [GB] United Kingdom ..... 9101444

[51] Int. Cl.[6] ..... B32B 7/08

[52] U.S. Cl. ..... 428/253; 66/196; 66/198; 66/202; 428/101; 428/298; 428/302

[58] Field of Search ..... 428/101, 253, 298, 302; 66/196, 198, 202

[56] References Cited

U.S. PATENT DOCUMENTS

| | | | |
|---|---|---|---|
| 5,027,618 | 7/1991 | Robinson et al. | 66/202 |
| 5,166,480 | 11/1992 | Bottger et al. | 181/292 |
| 5,284,031 | 2/1994 | Stoll et al. | 66/196 |

FOREIGN PATENT DOCUMENTS

| | | |
|---|---|---|
| 339227 | 11/1989 | European Pat. Off. . |
| 0421041A1 | 4/1991 | European Pat. Off. . |
| 2652053 | 5/1977 | France . |
| 2618316 | 11/1977 | France . |
| 2415682 | 8/1979 | France . |
| 3139402 | 4/1983 | France . |
| 130753 | 2/1919 | United Kingdom . |
| 1028526 | 5/1966 | United Kingdom . |
| 1030674 | 5/1966 | United Kingdom . |
| 1441256 | 6/1976 | United Kingdom . |
| WO89/03759 | 5/1989 | WIPO . |

OTHER PUBLICATIONS

*World Patent Index Latest*, Section Ch, Week 8903, Derwent Publ. Ltd., London, GB; Class F, AN8-9-019789 and JP, A, 63-295,746 (Nippon Muki) Dec. 2, 1988.

Fairchild's Dictionary of Textile, published 1967—see entry on "glass fibre" on pp. 256-257.

*Primary Examiner*—James C. Cannon

*Attorney, Agent, or Firm*—Howson & Howson

[57] ABSTRACT

A thermal insulating material comprising a double-faced knitted glass fibre fabric in which the faces (16, 17) of the fabric are interconnected by at least one linking thread (18) which passes from one face (16) to the other (17).

23 Claims, 3 Drawing Sheets

THERMAL INSULATION MATERIALS

FIELD OF THE INVENTION

This invention relates to thermal insulation materials and to a method of manufacturing such materials.

BACKGROUND OF THE INVENTION

There is a need for a lightweight flexible sheet material which has low thermal conductivity, but which can be fabricated into thermal insulation blankets or panels. Ideally such flexible sheet materials should be safe to use and not produce dust or fibre particles which can be inhaled or cause irritation to the skin of anyone who comes into contact with the material. There are some applications which require such sheet material to be re-useable many times.

In some applications, the material has to withstand exposure to very high temperatures and also provide a thermal insulation barrier, and there are few materials which possess both resistance to high temperature and low thermal conductivity.

SUMMARY OF THE INVENTION

According to one aspect of the present invention there is provided a flexible thermal insulating fabric comprising a double-faced weft knitted structure formed by knitting yarn which comprises strands of air-textured glass fibre to produce two spaced knitted faces interlinked by yarn which passes from one knitted face to the other.

In a further aspect of the present invention there is provided a method of making a flexible thermal insulation fabric comprising the steps of weft knitting a double faced glass fibre fabric using yarn which comprises strands of air-textured glass fibre on a double needle bed weft knitting machine and interconnecting the faces of the fabric with at least one linking yarn which passes from one knitted face to the other. The or each linking yarn may be formed by tuck stitches which pass from one face of the fabric to the other.

In a preferred embodiment of the present invention, the thermal insulation material is knitted on a double needle bed weft knitting machine which uses a "V" bed with 2.5 gauge needles.

The spacing between the front bed needles and the back bed needles is suitably about 10 mm, and this dimension affects the overall thickness of the finished fabric as will be explained below. If desired the spacing between the front and back needle beds could be greater than 10 mm if thicker fabrics are required.

Preferably linking yarn in the form of tuck stitches are created by wrapping the at least one linking yarn around selected needles of both needle beds.

Preferably the or each linking yarn is a glass fibre thread.

In a preferred embodiment of the invention glass fibre threads are converted to silica by leaching the fabric in an aqueous solution containing hydrochloric acid.

In yet a further embodiment of the invention a leached fabric has a finish applied to at least one of the faces. The preferred finish is applied by immersing the fabric in a solution comprising 50% by weight vinylacetate ethylene copolymer latex and an aqueous silicone elastomer emulsion The preferred yarn for knitting comprises a plurality of strands of air-textured glass fibre (each of which is about 1700 decitex) fed to a yarn feeder of the knitting machine.

Preferably the thermal conductivity of the fabric, measured in a direction normal to both faces, is of the order of 0.01 to 0.20 w/m°k. Ideally the thermal conductivity is in the range of 0.10 to 0.125 w/m°k.

In one embodiment of the invention, the thermal insulation material may comprise a first substantially silica fabric joined to a second glass fibre fabric.

In a further embodiment of the invention the thermal insulation material may comprise a core fabric made of glass fibre and a silica fabric joined to the surfaces of the core fabric.

BRIEF DESCRIPTION OF THE DRAWINGS

The present invention will now be further described, by way of example, with reference to the accompanying drawings in which.

DESCRIPTION OF PREFERRED EMBODIMENTS

In all of the following examples, the thermal insulation material comprises a knitted fabric which has two knitted faces spaced apart in a direction along which heat, which is to be shielded by the fabric, flows. The two spaced faces are interconnected by stitches which pass from one face to the other so as to constitute a unitary body which has a low density (due to the presence of a large volume of air trapped between the two faces). The low density core so formed is substantially self supporting, that is to say that the two faces of the fabric, whilst able to be displaced if moved relative to each other by small amounts in directions parallel to the faces, are nevertheless tied together as a unitary body by the interlinking stitches so that the body is substantially self supporting.

Figure 1:
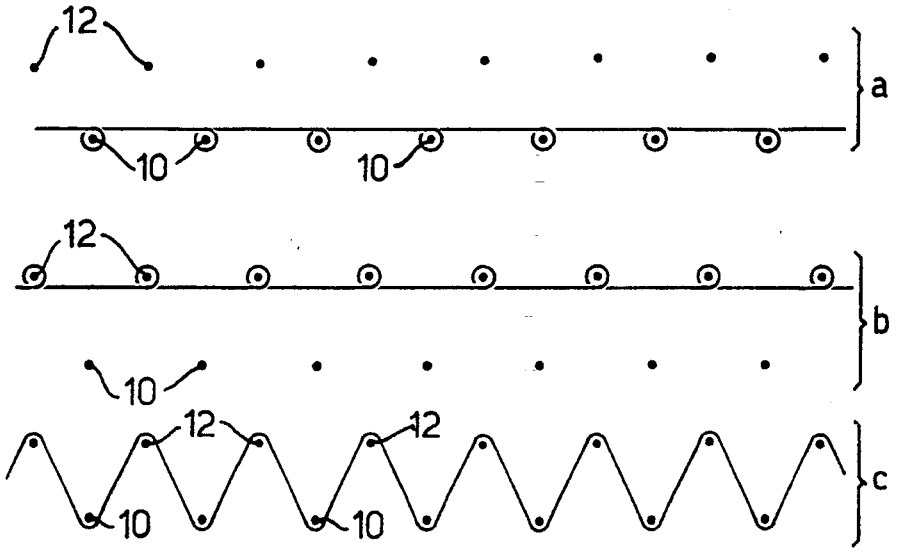
FIGS. 1 to 5 illustrate schematically the stitch patterns for knitting five thermal insulation materials in accordance with the present invention.

Referring to the stitch pattern diagram of FIG. 1, a first course is knitted on all the needles 10 of the front bed of needles (stage (a)).

A second course is then knitted on all the needles 12 of the back bed of needles (stage (b)). The third course is formed by wrapping the yarn around the needles 10 of the front bed across the gap between the front and back needle beds and around the needles 12 of the back bed (stage (c)).

This three-course pattern is then repeated until the desired length of fabric is produced. The resulting fabric comprises two fabric faces interconnected by the tuck stitches formed by each third course of the repeated pattern.

The overall thickness of the fabric is dependent upon the distance between the needles of the front bed and the needles of the back bed, the gauge of the needles and the tension of the yarn used to make the tuck stitches in each third course.

The typical weight of a fabric made in accordance with the stitch pattern illustrated in FIG. 1 is about 3 kg per square meter, and the fabric has a thickness of about 13 mm. The thermal conductivity is typically 0.125 w/m°k, measured in the direction normal to both faces.

Figure 2:
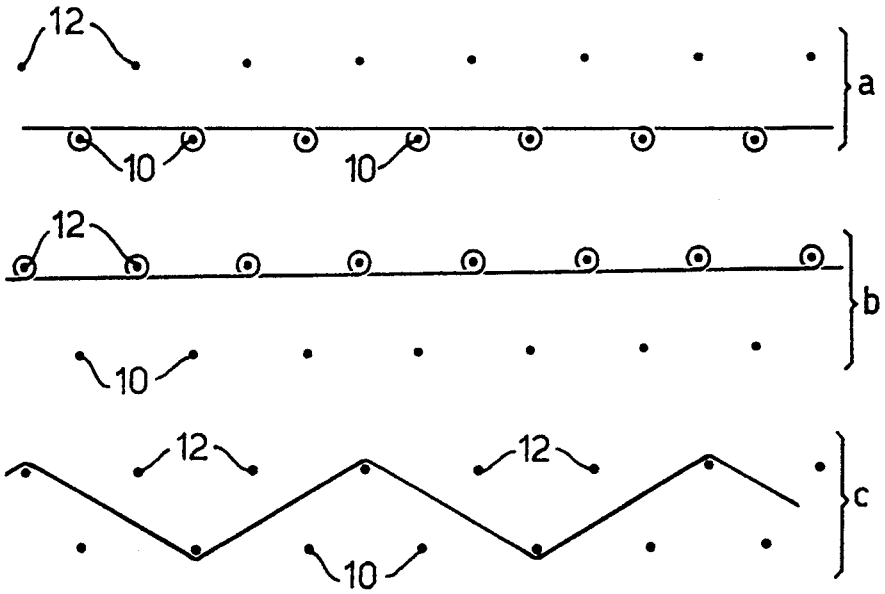

In the above-described stitch pattern, the third course is wound around all the needles of each needle bed. If desired, the thread may be wound around only some of the needles of each bed as shown in course (c) of FIG. 2. This has the advantage of reducing the total weight of the fabric for a given thickness. Referring to FIG. 2, the same thickness glass fibre yarn is used as that used in FIG. 1 and the first two courses are knitted exactly as described with reference to FIG. 1.

Figure 3:
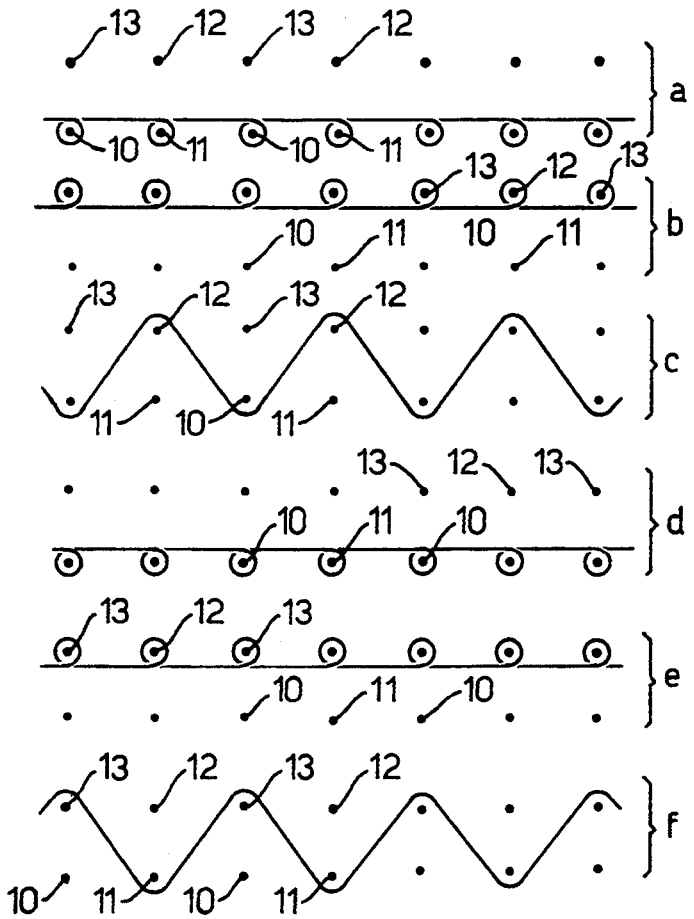

In a further embodiment of the present invention the stitch pattern shown in FIG. 3 is used. The first and second courses are knitted as described above with reference to stages (a) and (b) of FIG. 1. A third course is formed by wrapping the thread from alternate needles 10 of the front needle bed to alternate needles 12 of the back bed as shown in 3(*c*). The pattern is repeated except that the sixth course is formed by wrapping the interlinking thread from the alternate needles 11 of the front bed to the alternate needles 13 of the back bed as shown in 3(*f*). If desired, different thickness yarns may be used for the third and sixth courses.

Figure 4:
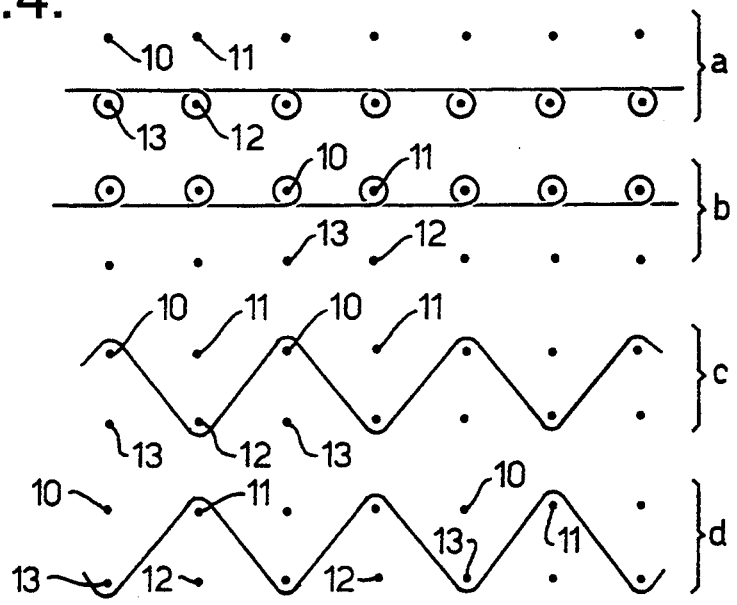

In yet a further embodiment of stitch pattern shown in FIG. 4, a double zig-zag tuck stitch pattern can be achieved by knitting the first two courses as described in connection with FIG. 1, but forming the third course by wrapping interlinking thread around alternate needles 10 of the front bed and around the alternate needles 12 of the back bed as shown in 4(*c*). A fourth course is formed by wrapping the same or a different interlinking thread around the alternate needles 11 of the front bed and the alternate needles 13 of the back bed as shown in 4(*d*). The pattern of these four courses is then repeated until the desired length of fabric is produced.

Figure 5:
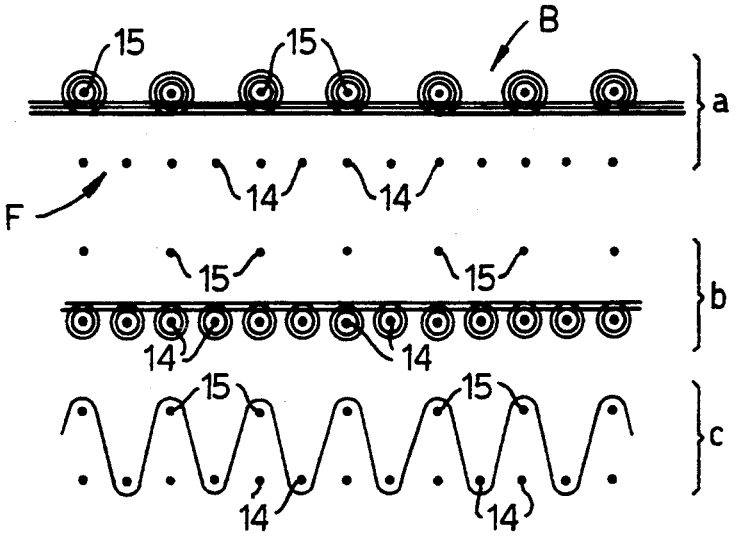

In yet a further embodiment shown in FIG. 5, one face F of the fabric is knitted on 5 gauge needles 14 and the other face B of the fabric is knitted on 2.5 gauge needles 15.

Referring to FIG. 5, the first course is knitted on all the back bed needles 15 using a glass fibre yarn comprising five threads, each of 1700 decitex as shown in FIG. 5(*a*). The second course is knitted on all the needles 14 of the front bed using two strands of 1700 decitex glass fibre as shown in FIG. 5(*b*).

The third course is formed by wrapping a thread of glass fibre, comprising two strands of 1700 decitex glass fibre, around all the needles 15 of the back bed and alternate needles 14 of the front bed as shown in FIG. 5(*c*).

The resultant fabric has the one face F which is of relatively tight knitted stitches knitted on the smaller (5 gauge) needles 14 and the other face B exhibits relatively loose stitches, knitted on the larger needles 15. The tight knitted face F may provide a better surface for subsequent coatings (as described hereinafter) than the loose knit face B.

Figure 6:
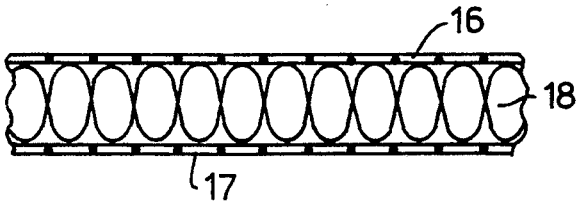
FIGS. 6 to 8 show schematically the cross-section of three materials made in accordance with the present invention.

All of the materials produced as described above with reference to FIGS. 1 to 5 comprise two faces 16,17 (shown in FIG. 6) linked together by tuck stitches 18 formed by wrapping the glass fibre thread around selected needles of both beds as described above. The resulting materials have low thermal conductivity and, because of the unique combination of the needle size, thickness of yarn, and tension of the yarn, are lightweight and very flexible and safe to handle. All the products produced as described above offer effective thermal insulation for low temperature application (up to for example 700° C). However, the glass fibres will soften or melt at about 700° C. so, if the product is required to withstand exposure to heat at temperatures above 700° C., it is necessary to apply further coatings to at least that surface of the fabric exposed to the high temperature.

In one embodiment, a coating comprising a refractory material such as a vermiculite slurry is applied to one or both faces of the fabric. In another embodiment a perfluorocarbon such as PTFE may be applied to one or both surfaces.

In yet a further embodiment of the present invention the knitted fabric, produced as described above (other than that it has a vermiculite coating applied to it), is leached by immersing the fabric in a leachant which comprises hydrochloric acid in order to convert the glass fibre to silica. A fabric made by the method of FIG. 1, which started at 13 mm thickness before leaching, reduces to about 10 mm overall thickness after leaching. Approximately 98% of the glass is converted to silica. The leached fabric still retains its flexibility but will withstand exposure to temperatures of up to 1600° C. before the silica melts. The thermal conductivity of the leached fabric is of the order of 0.10 w/m° k.

In a preferred embodiment, the leached fabric has a finish applied to at least both faces of the fabric in order to provide abrasion resistance and to suppress the creation of dust. A preferred method of applying the finish comprises the steps of immersing the leached fabric in a finish solution comprising 50% by weight vinylacetate ethylene copolymer latex (an example being that sold under the trade mark VINAMUL 3237) and an aqueous silicone elastomer emulsion (an example being that sold under the trade mark ULTRATEX FSB).

Figure 7:
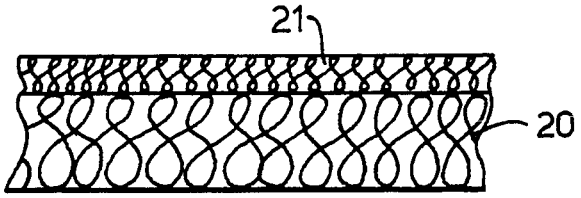

Referring to FIG. 7 there is shown, schematically, a thermal insulation material constructed in accordance with the present invention. The material is suitable for use as a thermal insulation blanket that can be wrapped around a component such as a pipe.

The material comprises an unleached fabric 20 manufactured as described above with reference to any one of FIGS. 1 to 5 and a leached fabric 21 manufactured as described above with reference to any one of FIGS. 1 to 5, leached in aqueous hydrochloric acid to convert the glass fibre to silica as described above and coated with a finish by immersing in the finish solution described above.

The fabric 20 is secured to the fabric 21 by stitching, stapling or by means of an adhesive so as to form a unitary body which is flexible. Such a body has the ability to withstand high temperatures because of the layer 21 and possesses low thermal conductivity because the layer 20 is a low density fabric with many voids formed within the fabric.

Figure 8:
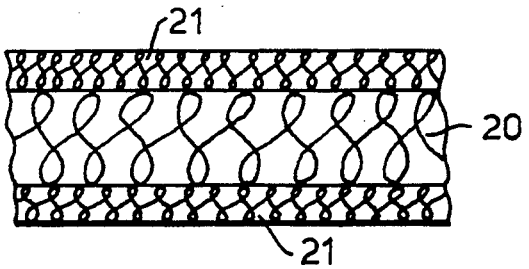

If desired, a unitary body could be made comprising an unleached core fabric 20 (made as described above) clad on both sides with a leached fabric 21 (made as described above). An example of such a fabric is shown in FIG. 8.

In the above examples, the leaching of the glass fibres to form silica is carried out by immersing the whole fabric destined to form the layer 21 in the leachant.

In the above examples the thickness of the fabric is determined by the width of the gap between the needle beds. Conventional V-bed weft knitting machines can be adapted to be used to make fabrics in accordance with the present invention. The common practice with conventional V-bed machines is to design the shape of the cams which control the throw, or movement of the needles so that after the needles are pulled to a maximum position when forming the loops on the needles they are backed-off a small amount to release tension so as to avoid breaking the thread. In the context of the present invention, it is desired to produce the thickest possible fabric (for thermal insulation reasons) and backing off the needles to relax tension would not optimise the thickness of the fabric. Therefore, it is contemplated that the cams of a conventional V-bed machine could be modified so as to reduce, or possibly eliminate, the amount that the needles are backed off to relieve tension. Such a design modification would be unusual for knitting textile fabrics and for most glass fibre fabrics would be an unnecessary and unneeded expense. However, for the purposes of the present invention, one can achieve slightly thicker thermal insulating fabrics for a given gap between needle beds by not backing off the needles, than one can achieve when backing off the needles. Surprisingly, this has been achieved without breaking the glass fibre interlinking threads, which in any case are relatively thicker than the more usual glass fibre threads used for fabrics.

We claim:

1. A flexible thermal insulating fabric comprising a double-faced weft knitted structure formed by knitting yarn which comprises strands of air-textured glass fibre to produce two spaced knitted faces interlinked by yarn which passes from one knitted face to the other.

2. A flexible thermal insulation fabric according to claim 1, wherein the fabric is formed by knitting on a double needle bed knitting machine.

3. A flexible thermal insulation fabric according to claim 2, wherein the yarn comprises a plurality of strands of glass fibres each of which is about 1700 decitex.

4. A flexible thermal insulation fabric according to claim 1, having a thermal conductivity, measured in a direction normal to both faces, of the order of 0.10 to 0.20 w/m° k.

5. A flexible thermal insulation fabric according to claim 4, wherein the thermal conductivity is in the range of 0.10 to 0.125 w/m°k.

6. A flexible thermal insulation fabric according to claim 1, wherein both faces are knitted on the same gauge needles.

7. A flexible thermal insulation fabric according to claim 1, wherein one face is knitted on larger gauge needles than the other face.

8. A flexible thermal insulation fabric comprising a double-faced weft knitted structure formed by knitting yarn which comprises strands of air-textured glass fibre to produce two spaced knitted faces interlinked by yarn which passes from one knitted face to the other, the yarn comprising tuck stitches which pass from one face to the other face.

9. A flexible thermal insulation fabric comprising a double-faced weft knitted structure formed by knitting yarn which comprises strands of air-textured glass fibre to produce two spaced knitted faces interlinked by yarn which passes from one knitted face to the other, wherein at least some of the glass-fibre is converted to silica.

10. A flexible thermal insulation fabric comprising a first fabric according to claim 9 joined to a second fabric comprising a double-faced weft knitted structure formed by knitting yarn which comprises strands of air-textured glass fibre to produce two spaced knitted faces interlinked by yarn which passes from one knitted face to the other.

11. A flexible thermal insulation fabric comprising a core fabric made of flexible thermal insulating fabric comprising a double-faced weft knitted structure formed by knitting yarn which comprises strands of air-texture glass fibre to produce two spaced knitted faces interlinked by yarn which passes from one knitted face to the other, and a fabric constructed in accordance to claim 9 joined to the faces of the core fabric.

12. A flexible thermal insulation fabric according to claim 9, wherein a finish comprising a vinylacetate ethylene copolymer latex is applied to one or more surfaces of the fabric.

13. A flexible thermal insulation fabric comprising a double-faced weft knitted structure formed by knitting yarn which comprises strands of air-textured glass fibre to produce two spaced knitted faces interlinked by yarn which passes from one knitted face to the other, and wherein at least one of the faces of the fabric is coated with a refractory material.

14. A method of making a flexible thermal insulation fabric comprising the steps of weft knitting a double faced glass fibre fabric using yarn which comprises strands of air-textured glass fibre on a double needle bed weft knitting machine and interconnecting the faces of the fabric with at least one linking yarn which passes from one spaced knitted face to the other.

15. A method according to claim 14, wherein both faces of the fabric are knitted on needles of the same gauge.

16. A method according to claim 14, wherein a first face of the fabric is knitted on needles of a larger gauge than that of the needles on which the other face is knitted.

17. A method according to claim 16, wherein the needles of one bed are of 5 gauge and the needles of the other bed are of 2.5 gauge.

18. A method according to claim 14, wherein the fabric is knitted using yarn which comprises a plurality of strands each of which is approximately 1700 decitex.

19. A method of making a flexible thermal insulation fabric comprising the steps of weft knitting a double faced glass fibre fabric using yarn which comprises strands of air-textured glass fibre on a double needle bed weft knitting machine and interconnecting the faces of the fabric with at least one linking yarn which passes from one spaced knitted face to the other, wherein the or each linking yarn is formed by tuck stitches which pass from one face of the fabric to the other.

20. A method according to claim 19, wherein the tuck stitches are formed by wrapping glass fibre threads around selected needles of one bed and selected needles of the second bed.

21. A method of making a flexible thermal insulation fabric comprising the steps of weft knitting a double faced glass fibre fabric using yarn which comprises strands of air-textured glass fibre on a double needle bed weft knitting machine and interconnecting the faces of the fabric with at least one linking yarn which passes from one spaced knitted face to the other, wherein the glass fibre fabric is leached by contacting the fabric with hydrochloric acid to convert at least some of the glass fibre to silica.

22. A method according to claim 21, wherein a finish is applied to the fabric by contacting the fabric with solution comprising 50% by weight vinylacetate ethylene copolymer latex and an aqueous silicone elastomer.

23. A method of making a flexible thermal insulation fabric comprising the steps of weft knitting a double faced glass fibre fabric using yarn which comprises strands of air-textured glass fibre on a double needle bed weft knitting machine and interconnecting the faces of the fabric with at least one linking yarn which passes from one spaced knitted face to the other, wherein a first face of the fabric is knitted on needles of one bed which are of larger gauge than the needles of the other bed, using a yarn which is thicker than the yarn used for knitting the second face.

* * * * *